US005958211A

United States Patent [19]

Traini et al.

[11] Patent Number: 5,958,211

[45] Date of Patent: Sep. 28, 1999

[54] METHOD OF REACTIVATING AN ELECTROLYZER

[75] Inventors: Carlo Traini; Tomaso Leone, both of Milan, Italy

[73] Assignee: De Nora S.p.A., Italy

[21] Appl. No.: 09/058,753

[22] Filed: Apr. 10, 1998

Related U.S. Application Data

[62] Division of application No. 08/820,225, Mar. 18, 1997, Pat. No. 5,779,876, which is a continuation of application No. 08/386,686, Feb. 10, 1995, abandoned.

[51] Int. Cl.[6] ..... C25B 1/26; C25B 1/00

[52] U.S. Cl. ..... 205/620; 205/625; 204/284; 29/402.03; 29/402.08

[58] Field of Search ..... 205/500, 502, 205/620, 621, 505, 531, 532, 618, 625; 204/284, 289; 29/592.1, 402.03, 402.08

[56] References Cited

U.S. PATENT DOCUMENTS

| | | | |
|---|---|---|---|
| 3,676,315 | 7/1972 | Goens et al. | 204/284 X |
| 3,940,328 | 2/1976 | Thomas et al. | 204/252 |
| 4,088,558 | 5/1978 | Fabian et al. | 204/288 |
| 4,401,530 | 8/1983 | Clere | 204/284 X |
| 4,464,242 | 8/1984 | Boulton | 204/284 X |
| 4,482,448 | 11/1984 | Bowen et al. | 204/284 |
| 5,454,925 | 10/1995 | Garland et al. | 204/284 X |
| 5,653,857 | 8/1997 | Getsy et al. | 204/288 X |

*Primary Examiner*—Donald R. Valentine
*Attorney, Agent, or Firm*—Bierman, Muserlian and Lucas

[57] ABSTRACT

A reactivation method for an electrolyzer for the production of sodium hydrochlorite and chlorate, equipped with interleaved plates acting as anodes and cathodes, wherein at least the anode plates are provided with foraminous sheets having an electrocatalytic coating and a planar profile, said sheets being applied to the anode plates by means of a multiplicity of connection points.

10 Claims, 6 Drawing Sheets

METHOD OF REACTIVATING AN ELECTROLYZER

PRIOR APPLICATIONS

This application is a division of U.S. patent application Ser. No. 08/820,225 filed Mar. 18, 1997, now U.S. Pat. No. 5,779,876 which is a continuation of U.S. patent application Ser. No. 08/386,686, filed Feb. 10, 1995, now abandoned.

STATE OF THE ART

The production of sodium chlorate is one of the most important electrochemical processes. Sodium chlorate is in fact the raw material for the production of sodium perchlorate, sodium chlorite and primarily chlorine dioxide, a highly appreciated reactant for water sterilization and more particularly for pulp and paper bleaching as a substitute of chlorine. In fact, differently from the latter, chlorine dioxide does not involve the formation of chlorinated by-products, such as chlorodioxins. Sodium chlorate is produced in undivided electrolyzers by electrolysis of sodium chloride solutions under controlled pH. The primary reaction product is a mixture of hypochlorite and hypochlorous acid which, operating at 70–90° C., is quickly transformed into chlorate and chloride. The system is optimized by suitably adjusting the ratio between the reaction volume and the electrode area. The essential characteristics of the process have been exhaustively discussed by R. E. Alford, in Electrosynthesis for the 1990's and beyond, 5th International Forum on Electrolysis in the Chemical Industry—Nov. 15, 1991 (U.S.A.).

As aforesaid, the electrolyzers for the production of sodium chlorate are of the undivided type, that is anodes and cathodes are not separated by foraminous diaphragms or ion exchange membranes.

The electrolyzers may be of the monopolar or bipolar type but in any case they are made of elementary units (cells) having a typical anode-cathode geometry. To reduce the volumes and maximize the electrode area, the anodes and cathodes have both a comb-like structure, consisting of a support wall to which metal plates are perpendicularly applied by bolting or welding, uniformly spaced apart. Welding is the preferred connection system in the most modern electrolyzers as it permits to reduce the spacing and obtain thus a particularly compact assembly. During assembling of the elementary units, the anode and cathode plates are positioned in order to have the anode plates inserted in the empty space between the cathodic plates and viceversa. Suitable spacers may be positioned in the interelectrodic space (gap) to prevent possible short-circuits. The cathodes or anodes are typically 5–15 mm spaced apart. Therefore, taking into consideration that each plate may have a thickness of 2–5 mm, the distance between two adjacent anodic and cathodic surfaces, so-called interelectrodic gap, is in the range of 1–5 mm.

The length of the plates, that is the distance between their external edge and the supporting wall, is usually determined by the need to have a homogeneous current distribution and clearly depends of the thickness of the plates. This problem is partly mitigated by the interleaved position of the cathode and anode plates which permits to balance the current distribution. Generally industrial electrode plates have a length in the range of 100–500 mm. Taking into consideration the said distance between the plates, it is clear that the comb-like structure of commercial anodes and cathodes is hardly accessible. For this reason, specific welding techniques using laser machines have been developed to weld the plates to the supporting walls for the construction of anodes and cathodes.

As regards the construction materials, generally the cathodes are made of carbon steel with a low content of both carbon and impurities while the anodes are made of pure titanium. As well known, titanium cannot be used as such, as it becomes coated by a thin, electrically insulating film soon after operation. For this reason the anode plates are provided with an electrocatalytic coating for chlorine evolution from chlorides, generally comprising at least one noble metal of the platinum group, such a platinum itself, ruthenium, palladium, iridium or oxides thereof as such or in admixture with other stabilizing oxides, as illustrated in U.S. Pat. No. 3,632,498, H. Beer. The coating wears out with time and therefore electrolysis must be stopped to provide for reactivation of the anodes. Reactivation involves a complex series of operations, such as unbolting or, worse, unwelding of the plates, removal of the residual coating, for example by sand-blasting, followed by pickling in acid solutions, such as 18–20% hydrochloric acid, in order not only to eliminate sand-blasting residues from the titanium surface but also to produce a suitable roughness necessary for good mechanical adhesion of the new electrocatalytic coating. The new coating is applied, e.g. by painting with solutions containing suitable precursor compounds which, during a subsequent thermal treatment, decompose to form the actual coating. The painting-thermal treatment cycle is repeated as many times as necessary to obtain a coating of suitable thickness. The coated plates are then welded to the supporting walls. It is evident that this series of complex operations may be carried out only in well-equipped facilities, where the anodes must be sent for reactivation. This involves considerable investment costs due to the fact that spare titanium structures must be available to permit continuous operation, while part of the structures sent to the re-coating facilities are out of use. Also evident are the additional costs connected to the shipment of the cumbersome structures as above described and to the reactivation procedure which is extremely demanding.

Moreover, the performance of conventional electrolyzers even before depletion of the electrocatalytic coating is not completely satisfactory. In fact, a certain amount of oxygen is evolved at the anodes. Oxygen is a useless by-product and therefore reduces the current efficiency for the desired reaction of chlorate formation.

Various solutions have been proposed to overcome the above problems and optimize the electrolyzers design and the composition of the electrocatalytic coating, as illustrated in the above mentioned publication by R. E. Alford. Electrodic structures quite similar to the ones used for the production of chlorate are used in electrolyzers exhaustively illustrated in the U.S. Pat. No. 4,108,756 directed to the production of diluted hypochlorite solutions by sea water or brine electrolysis. The diluted hypochlorite solutions are widely utilized for the sterilization of cooling circuits, drinkable water and waste waters. In a preferred embodiment of the electrolyzer described in U.S. Pat. No. 4,108,756, a multiplicity of elementary units are foreseen, each one made of an assembly of bipolar parallel plates. The plates are made of titanium, and portion thereof is provided with an electrocatalytic coating for chlorine evolution from chloride, having a composition similar to the one used for chlorate production. The coated portion of the plate acts as the anode, while the uncoated portion acts as the cathode, thus providing for a typical bipolar electrode. The various elementary units are assembled in an electrolyzer so that the coated portion of the plates of one unit is interleaved with the uncoated portion of the plate of the adjacent unit. Consequently the resulting geometrical configuration is similar to the one already described for chlorate electrolyzers.

Also in the case of hypochlorite production, the current efficiency is not quite satisfactory and a periodical substitution of the depleted electrodes must be carried out, with the consequent costs and difficulties, as already illustrated. Differently from modern electrolyzers for chlorate production, made by welded parts, the various plates of the electrodic package, as described in U.S. Pat. No. 4,108,756, are disassembled by removing suitable tie-rods and thus reactivation is much easier. However, this advantage is counterbalanced by a shorter lifetime of the electrodes due to the need of frequent acid washings to eliminate scales produced during electrolysis. These scales are made by precipitates of calcium and magnesium hydroxide and carbonate which adhere to the surface of the cathodic portions of the plates. In addition, the uncoated portion of the plate acting as the cathode with time tends to embrittle and deformate due to the penetration of hydrogen in the titanium crystal lattice. This type of damage is irreversible and the plates are practically irrecoverable.

SUMMARY OF THE INVENTION

The present invention describes a new electrode structure comprising a foraminous sheet having a planar profile applied onto the plates forming the elementary units of the electrolyzers. The foraminous sheet is provided with an electrocatalytic coating. According to the present invention, the two components of the electrode structure perform two different functions, in particular the foraminous sheet acts as the electrode, while the plate performs the function of rigid support and current distributor. The new electrode structure may be obtained during the construction of a new electrolyzer or during reactivation of existing electrolyzers after prolonged operation, irrelevant whether originally produced according to the teachings of the prior art or according to the present invention, The new electrode structure of the present invention permits to overcome the disadvantages affecting both the operation (unsatisfactory current efficiency, fouling, deformation of the cathodes) and the reactivation of prior art electrolyzers.

These and other advantages will be better described in the following detailed description.

DESCRIPTION OF THE PREFERRED EMBODIMENTS

Figure 1:
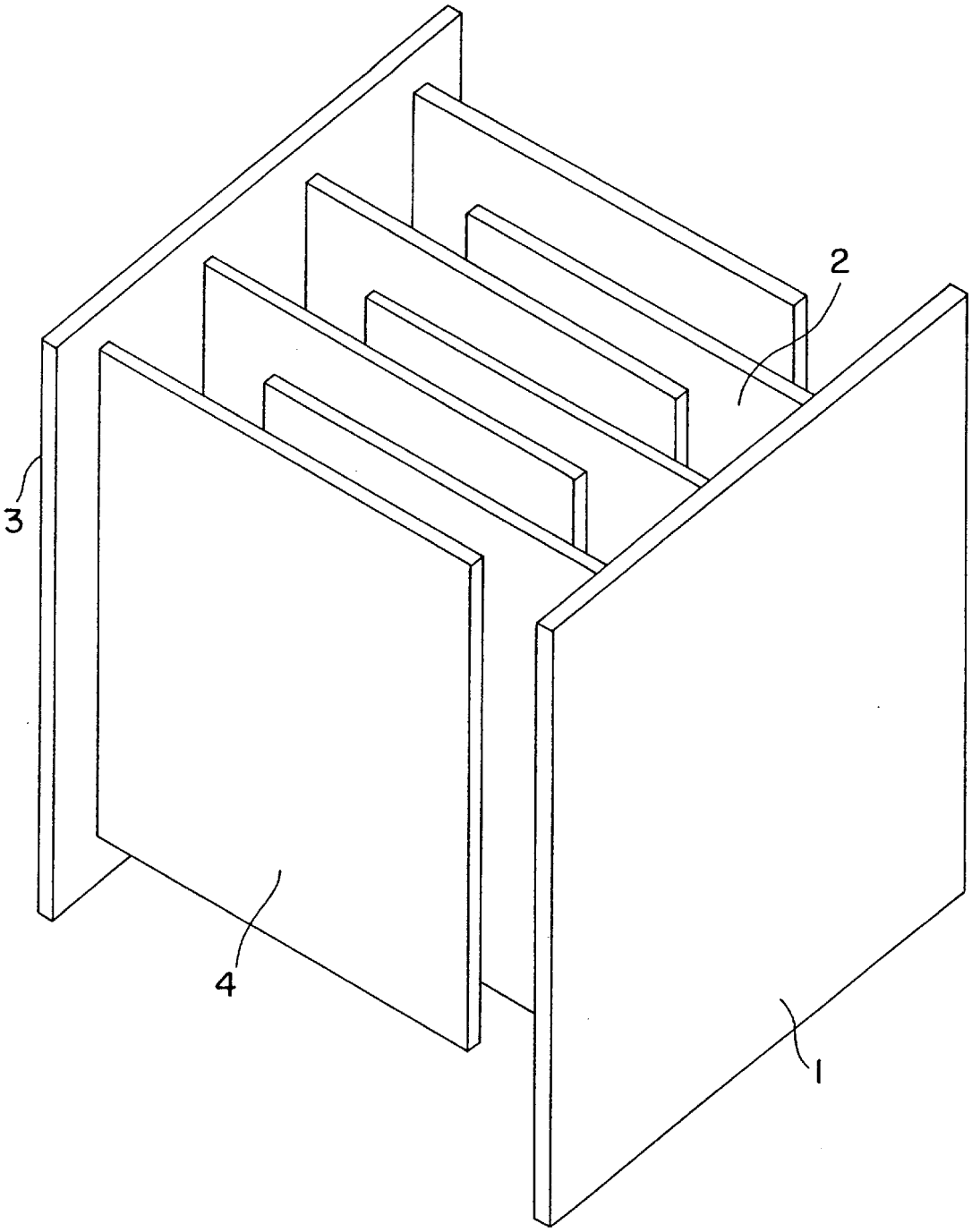
FIG. 1 PRIOR ART
FIG. 1 shows an elementary unit (cell) with alternately arranged anode and cathode plates, suitable for use in an electrolyzer for the production of chlorate according to the prior art teachings.

For a better understanding of the present invention, it is advantageous to consider in detail the mechanical structure of prior art electrolyzers for the production of chlorate and sodium hypochlorite. FIG. 1 shows an elementary unit (cell) of an electrolyzer suitable for the production of chlorate. In particular, the elementary unit comprises a supporting anodic wall (1) made in titanium, titanium plates (2) applied by welding to the wall (1) and provided with an electrocatalytic coating for chlorine evolution, a supporting cathodic wall (3) made in carbon steel, and plates (4) also made in carbon steel, without any coating, as carbon steel is sufficiently catalytic per se for hydrogen evolution. Said plates (4) are interleaved with plates (2) made in titanium. Industrial electrolyzers are made by a multiplicity of elementary units either electrically connected in series (bipolar electrolyzers) or in parallel (monopolar electrolyzers).

Figure 2:
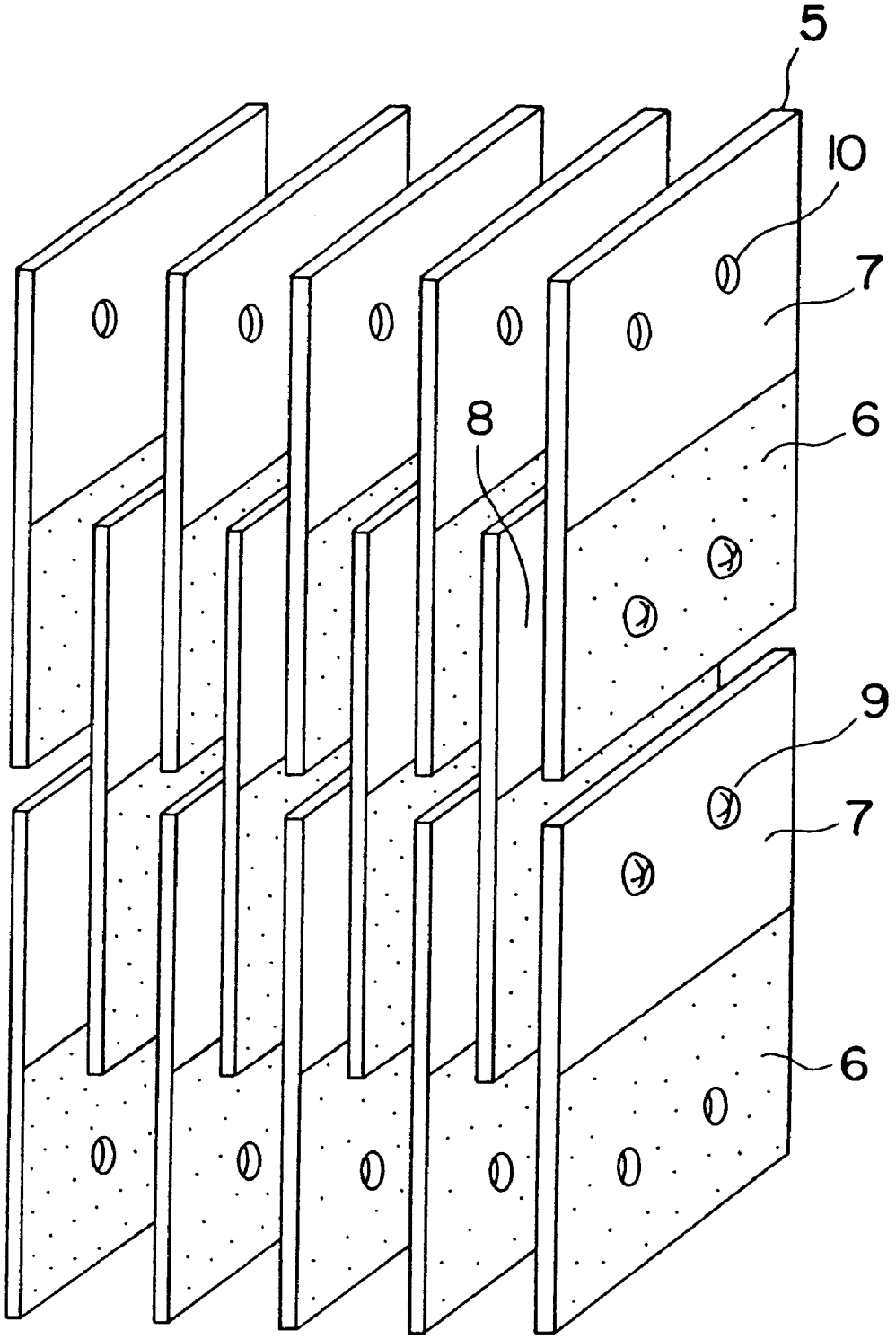
FIG. 2 PRIOR ART
FIG. 2 shows an elementary unit with bipolar plates for an electrolyzer for the production of diluted solutions of hypochlorite according to the prior art teachings.

The electrolyzer for the production of diluted solutions of sodium hypochlorite are equipped with a multiplicity of elementary units comprising interleaved bipolar plates as shown in FIG. 2. In this case, each plate (5), made in titanium, is provided on about half portion of its surface with an electrocatalytic coating (6) for chlorine evolution, to make this half portion suitable for acting as the anode.

The remaining uncoated portion (7) of the plate (5) acts as the cathode on which hydrogen is evolved. During electrolysis, electric current flows from the anodic portion (8) of the plate (5) of one elementary unit to the cathode portion (7) of the plate (5) of the adjacent elementary unit through the electrolyte which flows in the interlectrodic gap (8). Electric current flows longitudinally to the plate and reaches the anodic portion provided with the electrocatalytic coating, from which it continues likewise towards the plates of the next elementary unit. The various plates are connected to each other to form a unitary assembly by means of electrically insulated tie-rods (9) which cross the plates through holes (10).

The electrode structure of the invention comprises a foraminous sheet having a planar profile, provided with an electrocatalytic coating for chlorine evolution and applied to the plates or portion of plates of elementary units of an electrolyzer and suitable for acting as an anode.

Figure 3:
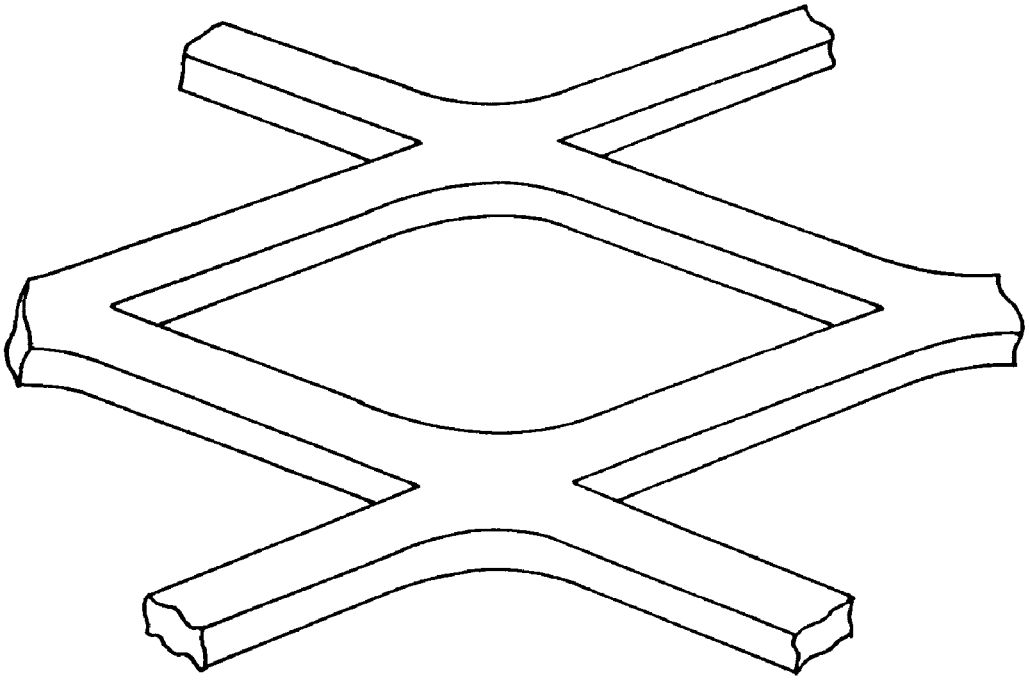
FIG. 3 shows a particularly preferred embodiment of the foraminous sheet of the invention made of an expanded metal sheet completely flattened.

Possible embodiments of the foraminous sheet may be perforated sheets and preferably, as illustrated in FIG. 3, flattened expanded metal sheets. The foraminous sheet is applied to the plates or portions of plates by means of a multiplicity of connection points by arc-welding or resistance welding. The number of connection points is determined by the need of providing for an efficient current transmission between the plates or portion of plates and the foraminous sheets of the invention rather than for mechanical considerations. For this reason the connection points are applied so as to form a square pattern with dimensions less or equal to 20 cm, preferably less than 10 cm, depending on the current density applied to the electrodes during operation of the electrolyzers, usually comprised between 1000 and 3000 Ampere/$m^2$. Usually the plate on which the foraminous sheet is applied has no electrocatalytic coating and thus in the electrode structure of the invention the two components, i.e. plate and foraminous sheet, perform two separate functions, in particular the plate acts as the current distributor and the foraminous sheet, provided with an electrocatalytic coating, acts as the real electrode.

Figure 4:
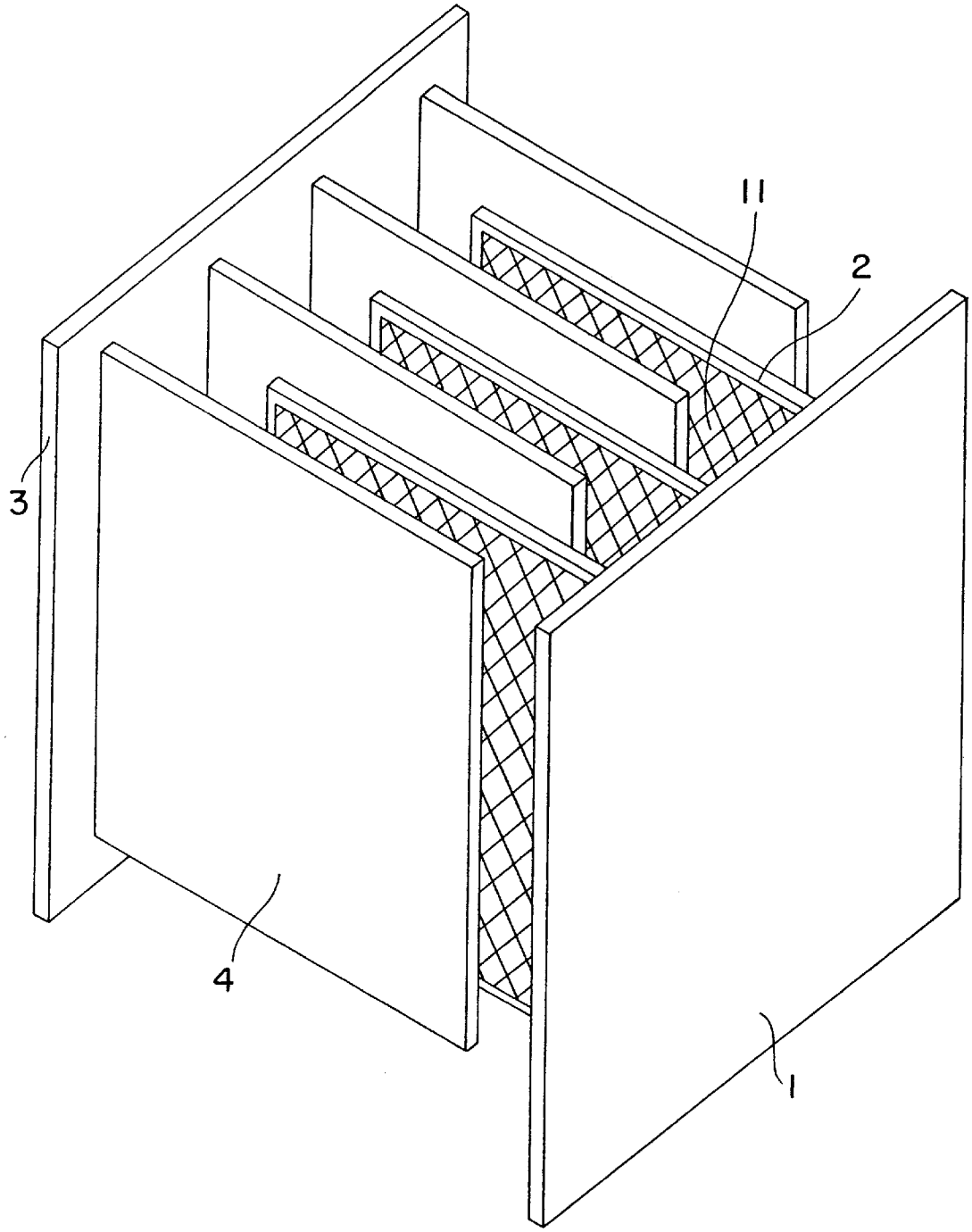
FIG. 4 schematizes the unit of FIG. 1 with the foraminous sheet of FIG. 3 applied to the anode plates.

FIG. 4 shows the elementary unit of FIG. 1 with the anodic plates (2) having applied on each side thereof the flattened and expanded metal sheet (11) of FIG. 3, provided with an electrocatalytic coating for chlorine evolution.

Figure 5:
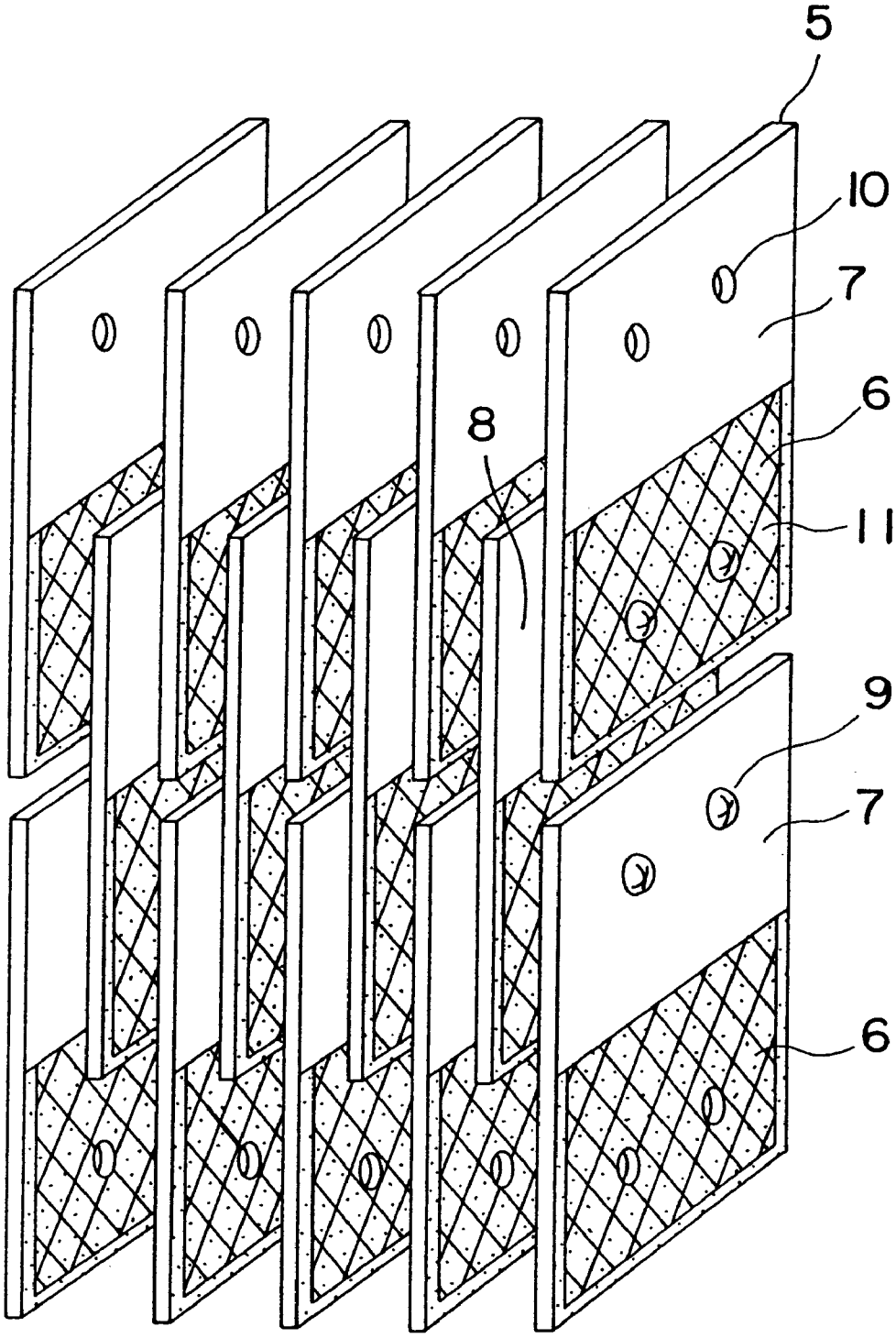
FIG. 5 schematizes the unit of FIG. 2 with the foraminous sheet of FIG. 3 applied only to the anodic portion of each plate.

The same type of sheet (11) is applied, as shown in FIG. 5, to the anodic portion (6) of each side of the bipolar plates (5) of the elementary unit of FIG. 2.

Figure 6:
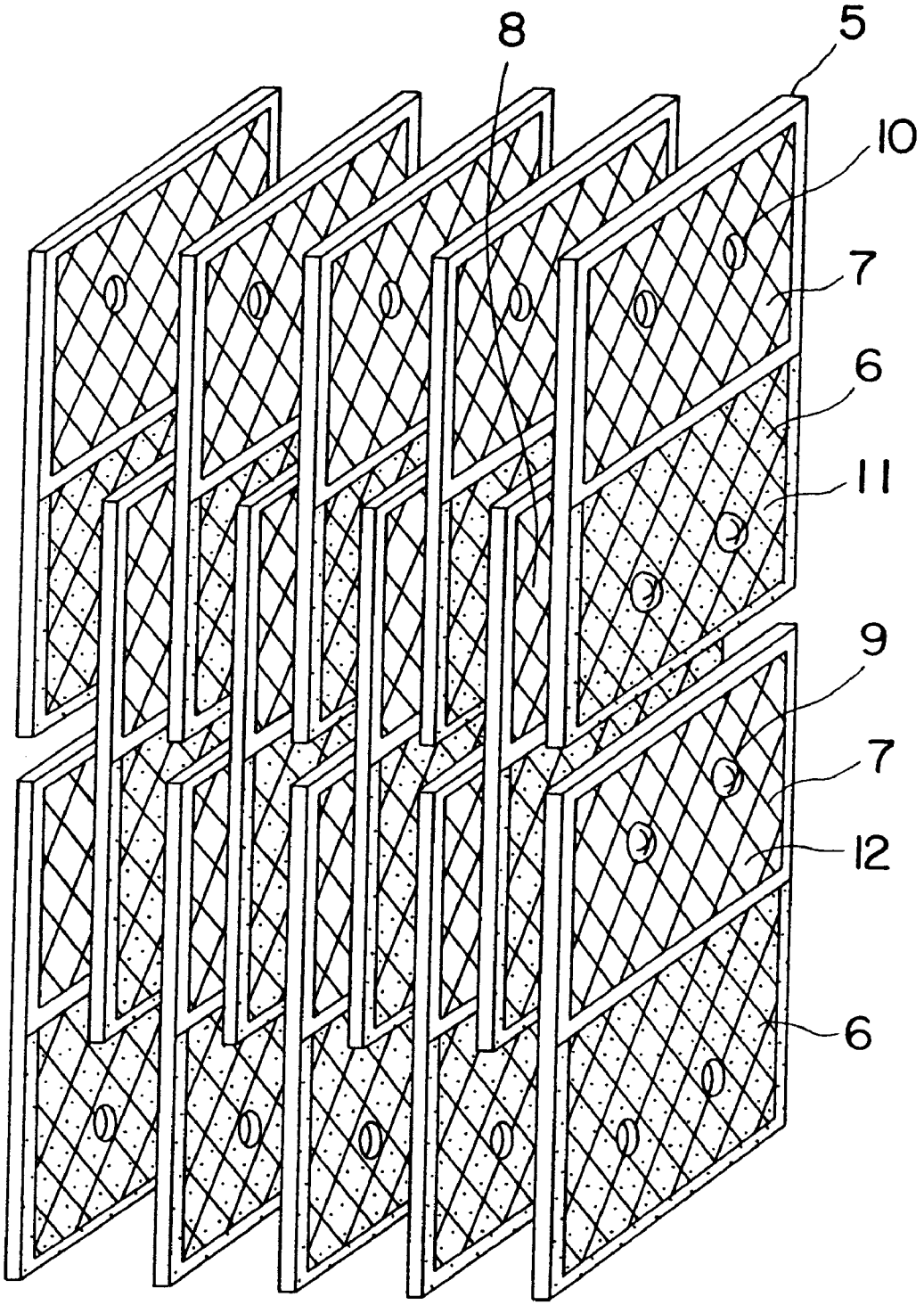
FIG. 6 schematized the unit of FIG. 2 with two foraminous sheets of FIG. 3 applied to both the anode and cathode portions of each plate.

FIG. 6 shows the elementary unit of FIG. 5 with the cathodic portions (7) of each side of the bipolar plates (5) also provided with the flattened and expanded metal sheet (12) of FIG. 3, provided in this case with an electrocatalytic coating for hydrogen evolution.

As already said, the sheet of the present invention is preferably foraminous, for example a perforated or expanded sheet, having a limited thickness and a flat profile. The limited thickness is imposed by the need not to decrease too much the distance (gap) between two adjacent electrodic structures which, in the elementary units of FIGS. 1 and 2, is of 1–5 mm. Therefore, the thickness of the sheet of the invention is 1 mm maximum, preferably 0.5 mm. As regards the porosity, this characteristic is essential for a number of reasons connected to the construction phase and to the operation of the electrolyzers. In fact, notwithstanding the limited thickness, a non-foraminous sheet maintains a certain rigidity. As distortion of sheets often occurs upon application of the electrocatalytic coating, a complete complete planarity is difficult to obtain when applying the sheets to the plates of the elementary units. Said planarity is required in view of the small distance (gap) existing between the adjacent surfaces of the of the interleaved plates. If the sheet is foraminous, e.g. a perforated or expanded sheet, the deformability is higher and the necessary planarity is easily achieved, thus greatly facilitating the welding procedure. Further, a foraminous sheet, when made of expanded metal, permits a great saving of the expensive material, such as titanium or nickel, used for the anodic and cathodic plates respectively. In fact said foraminous sheet may have a void ratio with respect to the total surface of over 50%.

Even more important, the use of a foraminous sheet ensures further advantages for the operation of industrial electrolyzers.

In fact, in the the case of chlorates production with electrolyzers equipped with the electrodic units of the present invention it has been surprisingly found that the quantity of produced oxygen is lower with respect to the one typical of conventional electrolyzers. This results in a current efficiency for the production of chlorate about 1.5% higher than the conventional one. As it has been found that the electrolysis voltage substantially remains unvaried around 3 Volts with a current density in the range of 2000–3000 Ampere/$m^2$, the gain in the current efficiency results in a saving of about 60 kWh/ton of produced sodium chlorate. In the production of hypochlorite solutions, a similar increase of the current efficiency is detected, also in this case due to the lower evolution of oxygen. In this case, when the bipolar plates of the elementary units are provided on both the anodic and cathodic portions with the foraminous sheets of the invention, for example flattened and expanded sheets, as illustrated in FIG. 6, the increase in current efficiency is even more evident, reaching 2–2.5%. In addition to this improvement of the current efficiency, also a remarkable decrease of the electrolyzer voltage is observed, of about 0.2 Volts for each elementary unit. This results in a decrease of 250 kWh per ton of produced sodium hypochlorite. It must be noted that a similar advantage could be obtained also in the case of electrolysis for the production of chlorate if the plates of the cathodic comb-like structures, made in carbon steel, were provided with the foraminous sheets of the present invention having an electrocatalytic coating for hydrogen evolution. The use of the coated foraminous sheets ensures a further advantage consisting in a dimensional stability of the plates or portion of cathodic plates, when these are made of titanium. In fact, titanium, due to the hydrogen discharge, undergoes a slow hydridization which causes with time a distortion of the plates with the possibility of short-circuits. With the foraminous sheets of the invention (FIG. 6) this negative event does not occur or is substantially postponed. This should be due primarily to the presence of the electrocatalytic coating characterized by a small concentration of absorbed atomic hydrogen, which is the hydridizing agent.

Another unexpected advantage ensured by the foraminous sheet of the present invention applied to plates or portion of plates acting as the cathodes is the reduced tendency to fouling. As initially explained, the electrolyzers for the production of diluted solutions of sodium hypochlorite are fed with sea water or brines obtained by dissolving raw salt. These solutions are rich in calcium and magnesium which react with the cathodic alkalinity forming insoluble hydroxides and carbonates. With conventional electrodes consisting of flat sheets, the precipitates adhere to the surface with the consequent clogging of the gap between adjacent plates. It is therefore necessary to frequently shut down the electrolyzers for acid washing. The reason why the foraminous sheet delays the adhesion of the precipitates is probably to be found in a high local turbulence generated by the surface geometry of the sheet, which thus acts as a self-cleaning device.

If the foraminous sheet, acting as an anode or a cathode, has not a flat profile, such as an unflattened expanded sheet, the current efficiency of the electrolyzer decreases. This negative effect could be connected to the fact that plates with an irregular profile create an excessive turbulence in the electrolyte flowing in the limited interspace between adjacent plates. As a consequence the electrolyte flow rate decreases and the mixing of the electrolyte increases with an increased mass transport of hypochlorite towards the anodic and cathodic surfaces where it is destroyed by reduction or oxidation.

The above described electrolyzers, essentially but not exclusively directed to the production of chlorate and sodium hypochlorite, are also affected by the problem of anodic reactivation when the electrocatalytic coating for chlorine evolution, although extremely resistant, becomes depleted after a certain electrolysis time.

According to the conventional reactivation procedure, the electrolyzers are disassembled and the electrodic elementary units are sent to the reactivation facilities where a new catalytic coating is applied. Although the electrode lifetime has been considerably improved nowadays, the reactivation procedures are still extremely complex, as already explained, and the maintenance costs are high.

As a further advantage, the present invention permits to overcome the shortcomings of the prior art reactivation procedure. Generally speaking, according to the teachings of the present invention, the reactivation procedure may be carried out directly on the plant site with an easy and cost-effective procedure. In particular, the electrolyzers, after a determined period of time, are excluded from operation and the elementary units forming the same are removed. The foraminous sheets with the exhausted electrocatalytic coating are then removed from the elementary units. This operation is quite simple as the connection points, in a suitable number as already seen, have a limited dimension and therefore a scarce mechanical resistance. Therefore the foraminous sheets may be simply torn off. The residual asperities are then eliminated from the surfaces of the electrodic plates, which are subjected to degreasing, optionally de-scaling, final washing and drying. After these preliminary preparation steps, a new foraminous sheet provided with an electrolytic coating is applied to the plates. This operation is particularly easy in the case of elementary units as shown in FIG. 2 where the various plates may be disassembled simply by removing the tie-rods. The application of new foraminous sheets may be carried out also in the case of elementary cells of the type shown in FIG. 1 wherein the various plates are welded to the supporting walls to form comb-like structures. In fact the operation is favoured by the fact that the connection points have a mechanical resistance which is rather limited so that they may be easily torn off during the reactivation procedure, but at the same time sufficient to avoid detachment during operation. Therefore, welding does not require high current and pressures of the welding heads. Welding is carried out using a welding machine equipped with welding heads of small volume and suitable length, capable therefore to penetrate into the limited interspace between the adjacent plates of the comb-like structure. As a conclusion, the application of the new foraminous sheets provided with the electrocatalytic coating onto the plates of the elementary units having a comb-like structure is easily carried out without the need to remove the plates from the relevant supporting walls.

In the case of conventional electrolyzers, equipped with elementary units provided with plates having an electrocatalytic coating applied thereto, after disassembling, only the steps of degreasing, de-scaling, washing and drying are required. In particular, the expensive procedure of removing the residual electrocatalytic coating is avoided.

The above discussion clearly illustrates the distinctive features of the present invention and some preferred embodiments of the same. However, further modifications are possible without departing from the scope of the invention, which is limited only by the following appended claims.

We claim:

1. A method of reactivating an electrolyzer comprising elementary units consisting of interleaved anodes and cathodes, each anode and each cathode formed by a metal plate, characterized in that, said anodes are provided with foraminous sheets, made of perforated sheets or flattened expanded metal sheets applied to said metal plates by a multiplicity of connection points, said foraminous sheets having an electrocatalytic coating for chlorine evolution applied thereto characterized in that it comprises the following steps:

removal from the electrolyzer of the anode metal plates provided with foraminous sheets, removal of the foraminous sheets having an exhausted electrocatalytic coating from the anode metal plates, removal of residual material from the anodic metal plates, washing and drying of the anodic metal plates, application of a new foraminous sheet having an active electrocatalytic coating on each anodic metal plate and connection of said anode metal plate and foraminous sheet by arc or resistance welding by means of a multiplicity of connection points.

2. The method of claim 1 wherein said foraminous sheets have a thickness equal or less than 1 mm.

3. The method of claim 1 wherein said foraminous sheets have a void ratio at least equal to 50% of the total surface.

4. The method of claim 1 wherein said foraminous sheets are made of perforated or expanded and flattened sheets.

5. The method of claim 4 wherein said expanded sheets have rhomboidal openings with a major diagonal comprised between 2 and 10 mm and a minor diagonal comprised between 1 and 5 mm.

6. The method of claim 1 wherein said foraminous sheets applied to the plates acting as the anodes are made of titanium.

7. The method of claim 1 wherein said connection points are arc or resistance electric welding points.

8. The method of claim 1 wherein said connection points form a square pattern having dimensions up to 20 cm.

9. The method of claim 1 wherein said plates acting as the cathodes are provided with a foraminous sheet.

10. The method of claim 1 wherein said foraminous sheets are provided with an electrocatalytic coating for hydrogen evolution.

* * * * *